United States Patent [19]

Egloff et al.

[11] Patent Number: 4,587,998

[45] Date of Patent: May 13, 1986

[54] FILLING-THREAD INSERTION GRIPPER FOR A RAPIER WEAVING MACHINE

[75] Inventors: Anton Egloff, Jona; Lothar Köhler, Tann-Rüti, both of Switzerland

[73] Assignee: Maschinenfabrik Sulzer-Rüti AG, Rüti, Switzerland

[21] Appl. No.: 673,085

[22] Filed: Nov. 19, 1984

[30] Foreign Application Priority Data

Dec. 14, 1983 [EP] European Pat. Off. ..... 83810590.6

[51] Int. Cl.[4] ..... D03D 47/18

[52] U.S. Cl. ..... 139/448

[58] Field of Search ..... 139/447, 448

[56] References Cited

U.S. PATENT DOCUMENTS 3,580,291 5/1971 Piccoli ..... 139/448

4,071,055 1/1978 Haltmeier et al. ..... 139/448

4,418,727 12/1983 Santucci ..... 139/448

*Primary Examiner*—Henry S. Jaudon

*Attorney, Agent, or Firm*—Werner W. Kleeman

[57] ABSTRACT

In the filling-thread insertion element or delivery gripper, a transport clamping tongue supports an upper supplementary clamping tongue which is provided with a slot. The upper supplementary clamping tongue is appreciably thinner than the transport clamping tongue. The upper supplementary clamping tongue can therefore lie elastically against a clamping location between the transport clamping and upper supplementary clamping tongues on the one hand and a clamping jaw on the other hand. Furthermore, the upper supplementary clamping tongue is adjustable by means of a screw, which enables its clamping force to be adapted to the filling or weft thread currently employed, respectively to its thickness. It is in this manner possible to perform double-pick or weft insertion with secure clamping of two filling or weft threads in a weft thread entry slot.

7 Claims, 8 Drawing Figures

PRIOR ART
Fig. 3
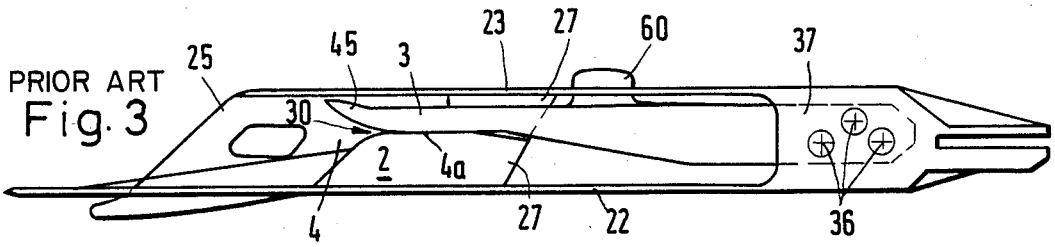
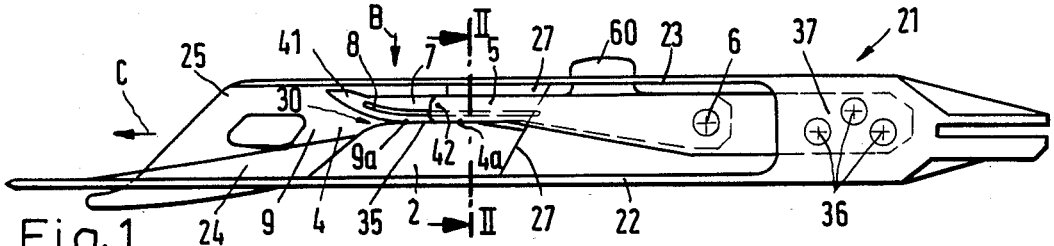
Fig. 1
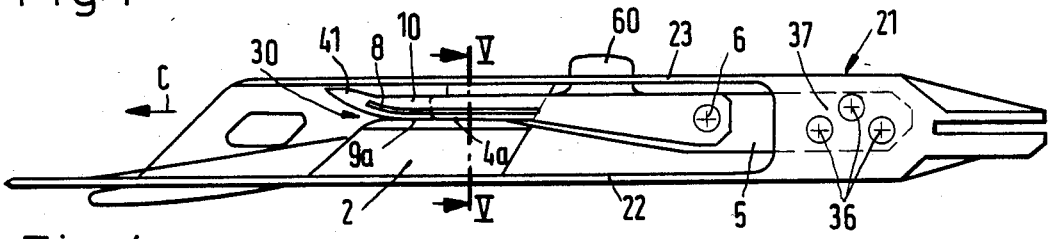
Fig. 4

Fig. 2
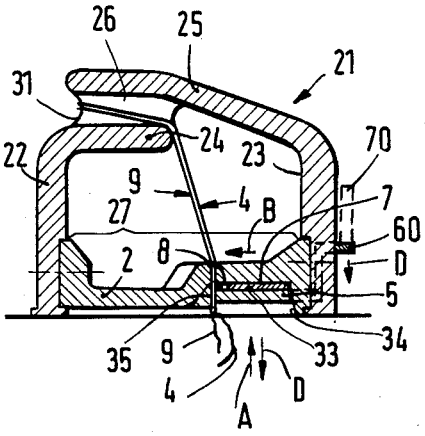
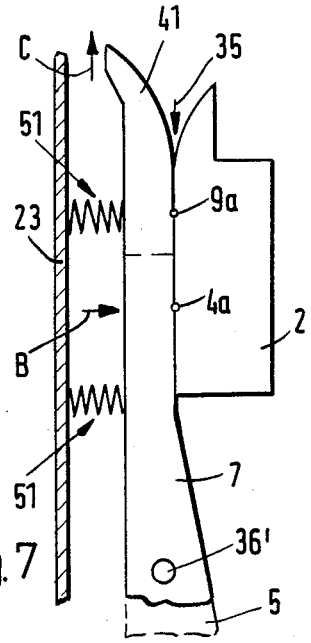
Fig. 7
Fig. 5
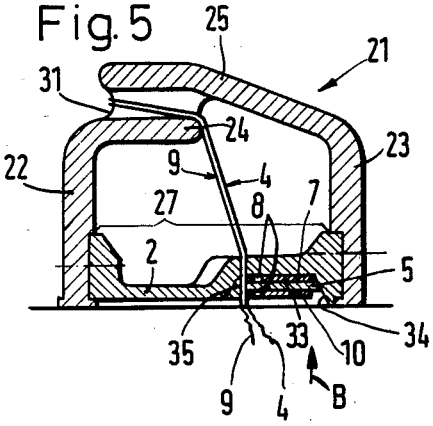
Fig. 6
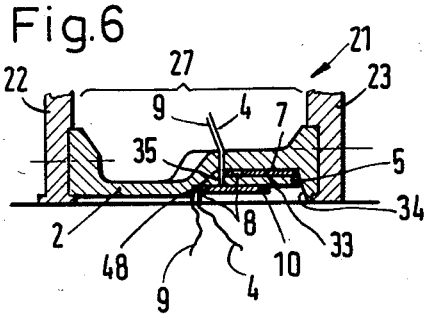
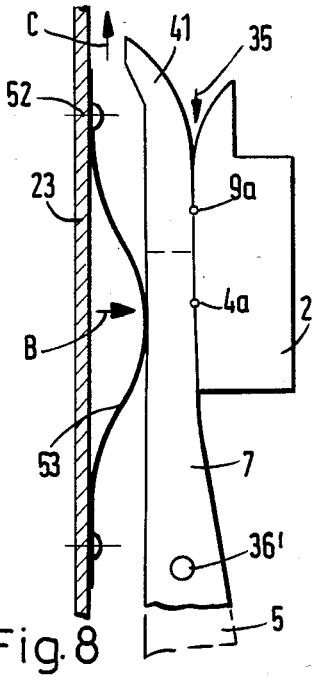
Fig. 8

FILLING-THREAD INSERTION GRIPPER FOR A RAPIER WEAVING MACHINE

BACKGROUND OF THE INVENTION

The present invention broadly relates to weaving machines and, more specifically, pertains to a new and improved construction of a filling-thread insertion or delivery gripper for a rapier or gripper weaving machine.

Generally speaking, the filling-thread insertion or delivery gripper of the present invention is intended for flexible insertion band or tape or insertion rod type rapier weaving machines and comprises a transport clamping tongue or element lying against a stationary clamping jaw or member mounted in the filling-thread insertion or delivery gripper to form therewith a clamping slot for clamping the filling or weft thread or pick to be inserted into the weaving shed.

In other words, the filling-thread insertion element or gripper of the present invention comprises a stationary clamping jaw mounted in the filling-thread insertion element or gripper, a transport clamping tongue having a free end and a direction of longitudinal extent and lying against the stationary clamping jaw to form conjointly therewith a clamping slot for clamping a filling or weft thread or pick which is to be inserted into a weaving shed of the rapier or gripper weaving machine.

In a heretofore known insertion or delivery gripper of this type, known for instance from the Swiss Patent No. 592,761, patented July 31, 1977 and cognate with the U.S. Pat. No. 4,071,055, granted Jan. 31, 1978, the transport clamping tongue comprises a pointedly converging free end having the same degree of rigidity as the remaining tongue portion. The entire transport clamping tongue is made of sheet steel. This transport clamping tongue is not able to act elastically in relation to the clamping jaw in a direction transverse to its longitudinal direction or extent. If two or more weft threads or picks, so-called double-picks are to be simultaneously inserted into the weaving shed of a rapier weaving machine with this arrangement, then only one of the threads can be clamped securely in the clamping slot between the clamping tongue and the clamping jaw and the remaining weft thread or threads can easily be lost or become disengaged from the clamping slot during weft thread insertion (mispick). The clamping action is only optimized for a single thread. For the other threads the clamping action is more or less weak and is not sufficient to attain reliable thread clamping.

SUMMARY OF THE INVENTION

Therefore, with the foregoing in mind, it is a primary object of the present invention to provide a new and improved construction of a filling-thread insertion or delivery gripper for a rapier or gripper weaving machine which does not exhibit the aforementioned drawbacks and shortcomings of the prior art constructions.

Another and more specific object of the present invention aims at providin9 a new and improved construction of a filling-thread insertion or delivery gripper of the previously mentioned type which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the filling-thread insertion or delivery gripper of the present invention is manifested by the features that the transport clamping tongue or element comprises at its free end an extension portion or tip which also elastically lies against the clamping jaw or member in a direction transverse to the longitudinal direction of the clamping tongue or element.

In other words, the filling-thread insertion or delivery gripper of the present invention comprises an extension tip mounted elastically with respect to a direction transverse to the direction of longitudinal extent of the transport clamping tongue at the free end of such transport clamping tongue and also lying against the clamping jaw.

It is in this manner possible to employ the filling-thread insertion or delivery gripper for multiple-pick insertion, especially for the so-called double-pick insertion, in which two or more filling or weft threads or picks are simultaneously clamped in the clamping slot between the transport clamping tongue or element and the clamping jaw or member with suitable and sufficient clamping force. Experiments have shown that a particularly secure thread clamping action exists in the clamping slot when the filling or weft thread first inserted into the clamping slot is somewhat thinner than the subsequently inserted filling or weft thread. Due to the elastic tongue extension portion or tip, it is also possible, for instance, to clamp two filling or weft threads of the same thickness securely in one and the same clamping slot and to insert them into the weaving shed. The filling or weft thread first introduced into the clamping slot can be clamped substantially by positive engagement or form-locking action, while the subsequently introduced filling or weft thread can be clamped substantially by non-positive engagement or friction-locking action.

In one embodiment of the invention, the extension portion or tip consists of at least one supplementary clamping tongue or element supported by the transport clamping tongue or element and which extends beyond the free end of the transport clamping tongue or element. This supplementary clamping tongue or element is mounted on the transport clamping tongue or element adjustably and fixably in a direction transverse to its direction of longitudinal extent. In this manner the clamping slot existing between the supplementary clamping tongue or element and the clamping jaw or member can be adapted to the thickness of the filling or weft threads to be inserted, whereby optimal clamping action for the filling or weft threads, especially for the subsequent filling or weft threads situated in the clamping slot, can be achieved.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein:

FIG. 1 schematically shows a bottom view of a filling-thread insertion or delivery gripper constructed according to the invention for a band-type rapier or gripper weaving machine;

FIG. 2 schematically shows a section taken along the line II—II in FIG. 1 and rotated through 90°;

FIG. 3 schematically shows for purposes of comparison, a known form of filling-thread insertion or delivery gripper in a bottom view corresponding to that of FIG. 1;

FIG. 4 schematically shows a bottom view of a modified embodiment of the invention;

FIG. 5 schematically shows a section taken along the line V—V in FIG. 4 and corresponding to the section of FIG. 2;

FIG. 6 schematically shows a section taken through a further embodiment and corresponding to the section of FIG. 5; and FIGS. 7 and 8 schematically show details of further embodiments on an enlarged scale.

DETAILED DESCRIPTION OF THE PREFERRED EMBODIMENTS

Describing now the drawings, it is to be understood that to simplify the showing thereof only enough of the structure of the filling-thread insertion or delivery gripper has been illustrated therein as is needed to enable one skilled in the art to readily understand the underlying principles and concepts of the present invention. Turning now specifically to FIG. 1 of the drawings, the apparatus illustrated therein by way of example and not limitation will be seen to comprise a filling-thread insertion or delivery gripper designated in its entirety with the reference numeral 21. The filling-thread insertion or delivery gripper 21 comprises two side walls 22 and 23 which have their continuation in two upper extensions or portions 24 and 25. The upper extensions or portions 24 and 25 overlap one another and are connected to one another by a connection member or web 26. The two side walls 22 and 23, the upper extension 25 and the web 26 define a housing of the delivery or filling-thread insertion gripper 21. In the lower portion of FIG. 2, it can be seen that the two side walls 22 and 23 are connected with one another by a web 27, whose left portion, as seen in FIG. 2, is constructed as a clamping jaw or member 2 for two filling or weft threads or picks 4 and 9 introduced into an entry slot 30 according to the arrow C for filling or weft insertion.

This web 27 contains a trapezoidal notch or recess 33 having an inclined edge or wall 34 and a vertical edge or wall 35. A transport clamping tongue or element 5 fastened to a rear web 37 of the filling-thread insertion or delivery gripper 21 by means of a screw connection 36 is guided in the notch or recess 33. The transport clamping tongue or element 5 supports an upper supplementary clamping tongue or element 7 fastened thereto by means of a screw or threaded member 6 and whose tip 41 extends beyond the free end 42 of the transport clamping tongue or element 5 to the left as seen in FIG. 1 and thereby forms an extension portion or tip of the transport clamping tongue or element 5.

As can be seen in FIG. 2, the upper supplementary clamping tongue or element 7 is constructed appreciably thinner than the transport clamping tongue or element 5. In the illustrative embodiment represented in FIG. 2, which is not necessarily to scale, the transport clamping tongue or element 5 is, for instance, 2 mm thick and the upper supplementary clamping tongue or element 7 is, for instance, 0.4 mm thick. The transport clamping tongue or element or element 5 and the upper supplementary clamping tongue or element 7 are pressed upwardly as seen in FIG. 2 (cf. arrow A) into the trapezoidal notch 33 of the web 27 by a suitable pre-stressing of the transport clamping tongue or element 5.

The upper supplementary clamping tongue or element 7 contains a slot 8. Due to this slot 8, as well as to the lesser thickness of the upper supplementary clamping tongue or element 7 relative to the thickness of the transport clamping tongue or element 5, the upper supplementary clamping tongue or element 7 can act or can be deformed elastically in the vertical direction of FIG. 1 and the horizontal direction of FIG. 2 (cf. arrow B), while the transport clamping tongue or element 5 is relatively rigid or immovable in this direction due to its robust construction. The upper supplementary clamping tongue or element 7 can furthermore be adjusted transversely relative to the transport clamping tongue or element 5 by a suitable adjustment of the screw or threaded member 6 and can be fixed in a desired position in which an entry slot 30 formed by the upper supplementary clamping tongue or element 7 and the clamping jaw or member 2 at the vertical wall 35 for the filling or weft threads 4 and 9 can be adapted to the type, and especially to the thickness, of these two filling or weft threads 4 and 9.

In FIG. 1 it is assumed that, when introducing the filling or weft threads or picks 4 and 9 into the entry slot 30 formed at the vertical wall 35 first a thinner filling or filling or weft thread or pick 4 and then a thicker filling or filling or weft thread or pick 9 are introduced. The thinner filling or filling or weft thread 4 is clamped at the location 4*a* between the transport clamping tongue or element 5 and the vertical wall 35 of the clamping jaw or member 2 substantially by positive engagement or form-locking action, while the thicker filling or filling or weft thread 9 is clamped at the location 9*a* between the upper supplementary clamping tongue or element 7 and the vertical wall 35 of the clamping jaw or member 2 substantially by non-positive engagement or friction-locking action.

Experience during weaving operation has shown that the upper supplementary clamping tongue or element 7 can be brought into an optimum position by means of the screw or threaded member 6, which in turn makes it possible to insert both filling or weft threads 4 and 9 simultaneously into the weaving shed of the associated weaving machine and to securely clamp the filling or weft threads 4 and 9 during this operation so that neither of them, especially not the outermost filling or weft thread 9 clamped at the position 9*a*, can be lost or unintentionally disengaged.

In a form of filling-thread insertion or delivery gripper known to the prior art and illustrated in FIG. 3, only a single transport clamping tongue or element 3 corresponding in thickness and pre-stressing or pre-bias to the transport clamping tongue or element 5 of FIG. 2 is provided. A forward end 45 of this transport clamping tongue or element 3 pointedly converges and forms conjointly with the clamping jaw or member 2 a corresponding entry slot 30 for a single filling or weft thread or pick 4. A second filling or weft thread or pick corresponding to the filling or weft thread 9 of FIG. 1 cannot be securely clamped in this construction. So-called double-pick insertion is not possible.

In the embodiment of the invention according to FIGS. 4 and 5, the transport clamping tongue or element 5 supports, in addition to the upper supplementary clamping tongue or element 7 shown in FIG. 5, a lower supplementary clamping tongue or element 10 constructed analogously to the upper supplementary clamping tongue or element 7. Reliability of clamping in the entry or introduction slot 30 can be thereby increased.

In the embodiment according to FIG. 6, which is modified in relation to the embodiment of FIG. 5, the clamping jaw or member 2 additionally contains a shoulder or step 48 in which the lower supplementary clamping tongue or element 10 lies. The filling or weft threads 4 and 9 are clamped by right-angled bends at the entry or introduction slot 30, the vertical wall 35 and the shoulder or step 48, which also leads to increased thread clamping reliability during double-pick insertion.

In the exemplary embodiment according to FIG. 7, the upper supplementary clamping tongue or element 7 is journaled at a pivot point 36' on the transport clamping tongue or element 5. The upper supplementary clamping tongue or element 7 has the same thickness as the transport clamping tongue or element 5 and therefore is itself principally inelastic in the direction of the arrow B. The elastic action or deformation in the direction of the arrow B is achieved in this embodiment by two compression springs 51 which tend to deflect or pivot the upper supplementary clamping tongue or element 7 in clockwise direction in FIG. 7 about the pivot point 36'. Non-positive engagement or friction-locking of the two filling or weft threads 4 and 9 in the positions **4*a* and 9*a* thereby arises, wherein the non-positive engagement or friction-locking action effective at the position 9*a* has a positive engagement or form-locking action superimposed upon it by the transport clamping tongue or element 5**.

In the embodiment according to FIG. 8 which corresponds to the embodiment of FIG. 7 in respect of the tongue or element thickness of the upper supplementary clamping tongue or element 7, the transverse elastic action in the direction of the arrow B is achieved by a leaf spring 53 fastened to the side wall 23 at the location indicated by the reference numeral 52.

In all embodiments of the invention, the upper and lower supplementary clamping tongues or elements 7 and 10 form a forward extension or tip of the transport clamping tongue or element 5. In the embodiments according to the FIGS. 1, 2, 4, 5 and 6, the upper and lower supplementary clamping tongues or elements 7 and 10 act or are deformed elastically due to their relatively slight thickness and due to the slot 8 as well as due to the possibility of adjustment in the direction of the arrow B provided by the screw or threaded member 6. The upper and lower supplementary clamping tongues or elements 7 and 10 therefore lie, in a desired manner which is optimal for the filling or weft threads 4 and 9, against the corresponding clamping surface of the clamping jaw or member 2 at the entry slot 30, the vertical wall 35 and the shoulder or step 48.

Subsequent to filling or weft thread insertion, the gripper or filling-thread insertion element 21 is moved out of the weaving shed. A tab or lateral tongue or element 60 arranged on the transport clamping tongue or element 5 is thereby moved under a stationary cam or profile 70 which moves the transport clamping tongue or element 5 and the upper supplementary clamping tongue or element 7 downward in the direction of the arrow D in FIG. 2 and against their spring or elastic action. In this position the entry slot 30 can be cleaned of fly lint or the like by a blower or vacuum device.

An embodiment of the present invention also results when, for instance, according to FIG. 3, only a single transport clamping tongue or element 3 is provided but whose forward portion comprising the tip 45 is constructed appreciably thinner than the remaining portion or when, for instance, such single transport clamping tongue or element 3 is of uniform thickness but is made of a flexible plastic, e.g. polyamide (nylon). In these two cases, too, a forward extension or tip of the transport clamping tongue or element which acts elastically in the direction of the arrow B also exists and enables double-pick insertion in the manner described.

Instead of two filling or weft threads or picks 4 and 9, if desired three or more filling or weft threads or picks can be introduced into the thread or introduction entry slot 30.

The transport clamping tongue or element 5 and the upper and lower supplementary clamping tongues or elements 7 and 10 can, for instance be made of steel.

While there are shown and described present preferred embodiments of the invention, it is to be distinctly understood that the invention is not limited thereto, but may be otherwise variously embodied and practiced within the scope of the following claims. Accordingly,

What we claim is:

1. A filling-thread insertion gripper for a rapier weaving machine, comprising:

a stationary clamping jaw;

a substantially rigid transport clamping tongue having a free end and lying in its direction of longitudinal extent against said stationary clamping jaw to form conjointly therewith a clamping slot for clamping in said clamping slot at least one filling thread;

said substantially rigid transport clamping tongue containing an extension tip and;

said extension tip being elastically deformable transversely to said direction of longitudinal extent at said free end of said substantially rigid transport clamping tongue.

2. The filling-thread insertion gripper as defined in claim 1, wherein:

said extension tip is appreciably thinner than said transport clamping tongue in order to be elastically deformable transversely to said direction of longitudinal extent of said substantially rigid transport clamping tongue.

3. The filling-thread insertion gripper as defined in claim 1, wherein:

said extension tip comprises at least one supplementary clamping tongue supported by said substantially rigid transport clamping tongue; and said at least one supplementary clamping tongue extending beyond said free end of said substantially rigid transport clamping tongue.

4. The filling-thread insertion gripper as defined in claim 3, wherein:

said at least one supplementary clamping tongue contains a slot extending longitudinally therethrough; and said slot enabling an elastic deformation of said at least one supplementary clamping tongue transversely to said direction of longitudinal extent of said substantially rigid transport clamping tongue.

5. The filling-thread insertion gripper as defined in claim 3, further including:

means for adjustably and fixedly mounting said at least one supplementary clamping tongue on said substantially rigid transport clamping tongue transversely to said direction of longitudinal extent of said substantially rigid transport clamping tongue.

6. The filling-thread insertion gripper as defined in claim 3, further including:

a gripper housing;

said gripper housing comprising a web;

said web partially defining said clamping jaw; and said substantially rigid transport clamping tongue and said at least one supplementary clamping tongue being elastically pressed against said web in a direction substantially transverse to said direction of longitudinal extent of said substantially rigid transport clamping tongue.

7. The filling-thread insertion gripper as defined in claim 6, wherein:

said web comprises a substantially trapezoidal notch;

said substantially rigid transport clamping tongue and said at least one supplementary clamping tongue being elastically pressed into said notch;

said notch defining a substantially inclined edge and a substantially vertical edge thereof; and said substantially rigid transport clamping tongue, said at least one supplementary clamping tongue, said substantially inclined edge and said substantially vertical edge conjointly forming a clamping slot for filling threads.

* * * * *